US006698594B2

(12) United States Patent
Cohen et al.

(10) Patent No.: US 6,698,594 B2
(45) Date of Patent: Mar. 2, 2004

(54) SCREENING MACHINE

(75) Inventors: Douglas J. Cohen, Columbus, OH (US); Steven A. Cohen, Pickerington, OH (US)

(73) Assignee: Ohio Central Steel Company, Reynoldsburg, OH (US)

( * ) Notice: Subject to any disclaimer, the term of this patent is extended or adjusted under 35 U.S.C. 154(b) by 5 days.

(21) Appl. No.: 10/100,455

(22) Filed: Mar. 18, 2002

(65) Prior Publication Data

US 2003/0173265 A1 Sep. 18, 2003

(51) Int. Cl.[7] ..... B07B 1/49
(52) U.S. Cl. ..... 209/421
(58) Field of Search ..... 209/680, 233, 209/240, 241, 242, 245, 247, 254, 255, 257, 261, 923, 925, 935, 420, 421, 317

(56) References Cited

U.S. PATENT DOCUMENTS

| | | | | | |
|---|---|---|---|---|---|
| 1,129,820 | A | * | 2/1915 | Trench | 209/420 |
| 2,161,073 | A | * | 6/1939 | Mehl | 209/240 |
| 2,793,747 | A | * | 5/1957 | Pridy | 171/130 |
| 2,814,387 | A | * | 11/1957 | McWilliams | 209/247 |
| 4,190,526 | A | * | 2/1980 | Bachand | 209/245 |
| 4,363,725 | A | | 12/1982 | Morita et al. | |
| 4,591,432 | A | * | 5/1986 | Hartl | 209/247 |
| 4,879,023 | A | * | 11/1989 | Mallaghan | 209/241 |
| 4,983,280 | A | * | 1/1991 | Eriksson | 209/241 |
| 5,033,932 | A | * | 7/1991 | Compton | 414/528 |
| 5,112,474 | A | * | 5/1992 | Douglas | 209/240 |
| 5,234,564 | A | * | 8/1993 | Smith | 209/241 |
| 5,285,905 | A | * | 2/1994 | Laprade | 209/288 |
| 5,292,006 | A | * | 3/1994 | Girts, Jr. | 209/242 |
| 5,333,725 | A | | 8/1994 | Douglas | |
| 5,479,726 | A | * | 1/1996 | Bishop | 37/142.5 |
| 5,577,618 | A | * | 11/1996 | Rafferty | 209/421 |
| 5,819,950 | A | * | 10/1998 | McCloskey | 209/241 |
| 5,957,302 | A | * | 9/1999 | Douglas | 209/421 |
| 5,979,666 | A | * | 11/1999 | Douglas | 209/241 |
| 6,000,554 | A | * | 12/1999 | Hughes | 209/314 |
| 6,065,606 | A | * | 5/2000 | Bonner | 209/420 |
| 6,098,812 | A | * | 8/2000 | Douglas | 209/420 |
| 6,186,338 | B1 | * | 2/2001 | Douglas | 209/421 |
| 6,336,558 | B1 | * | 1/2002 | Douglas | 209/421 |

FOREIGN PATENT DOCUMENTS

| | | | | |
|---|---|---|---|---|
| EP | 0.093.576 A2 | * | 11/1983 | B07B/1/46 |
| EP | 0.301.798 A1 | * | 2/1989 | B07B/13/16 |
| EP | 0.409.659 A1 | * | 1/1991 | B07B/1/28 |
| GB | 554680 | | 7/1943 | |
| GB | 2.034.606 A | * | 6/1980 | B03B/5/00 |

* cited by examiner

*Primary Examiner*—Donald P. Walsh
*Assistant Examiner*—Mark J Beauchaine
(74) *Attorney, Agent, or Firm*—Jason H. Foster; Kremblas, Foster, Phillips & Pollick

(57) ABSTRACT

A mobile screening machine with a frame on tracks, having a hopper and a main conveyor mounted to a frame. The main conveyor conveys particulate matter from the hopper to a screening device positioned beneath the upper end of the main conveyor. The particulate is screened into three grades of coarseness, with the coarsest falling into a chute, the middle coarseness falling onto one lateral conveyor and the finest falling onto an underscreen conveyor, which preferably is driven downhill onto another lateral conveyor. The tracks permit the machine to be driven around the work site and onto and off of a trailer, and the entire machine can be remotely controlled. The downhill conveyor permits loading of the hopper from both sides of the frame.

11 Claims, 12 Drawing Sheets

SCREENING MACHINE

BACKGROUND OF THE INVENTION

1. Field of the Invention

This invention relates generally to machines used for separating particulate of various sizes into separate piles of particulate of like size, and more particularly to an improved mobile machine that has a plurality of vibrating screens and conveyors for accomplishing particulate separation.

2. Description of the Related Art

It is well known to pour mixed particulate matter onto a vibrating screen to separate the particulate into matter with dimensions greater than the openings in the screen and matter with dimensions less than the openings in the screen. The matter with dimensions less than the openings in the screen falls by gravity through the screen openings and is collected beneath the screen. Alternatively, the particulate matter that falls through the screen can be directed onto a conventional conveyor that conveys the particulate away from the screening part of the machine and discharges it on a pile or in a container.

Many machines having such screens and conveyors are designed to be portable and have various combinations of vibrating screens and conveyors. Many are able to be towed on the road by a large vehicle, such as a tractor-trailer type tractor. As such, these machines ordinarily have hitches, legs and wheels conventional for towed vehicles. Alternatively, such machines can be towed onto a trailer and hauled by trailer. However, this can be difficult if the machine is the same size as the trailer.

The benefits of being roadworthy are significant, and often are a limiting factor in the design of these machines. For example, virtually every machine is restricted in width, length and height to maximum dimensions that enable the machine to be hauled on the highway.

One conventional machine is shown in U.S. Pat. No. 5,234,564 to Smith, in which a plurality of conveyors convey particulate from a hopper to a screening apparatus, and then into separate piles. Although this machine has advantages over the prior art, it also has disadvantages.

Therefore, the need exists for a screening machine that overcomes the disadvantages of the prior art.

BRIEF SUMMARY OF THE INVENTION

The invention is a portable machine for screening particulate. The preferred machine has an elongated frame, and the frame has a hopper end and an opposite, discharge end. A hopper is mounted to the hopper end of the frame and configured to receive particulate matter poured into the top of the hopper. A main conveyor is also mounted to the frame. The main conveyor has a receiving end beneath the hopper, and extends uphill toward a main conveyor rejecting end.

A screening device, preferably a vibrating screen driven by a rotary motor driving eccentric weights, has an upper screen and a lower screen. The screens have openings of different size, and the screening device is drivably mounted to the frame beneath the rejecting end of the main conveyor. The screening device extends from an upper end that is closer to the hopper end of the frame to a lower end that is closer to the discharge end of the frame. Thus, the screening device goes downhill away from the main conveyor.

An underscreen conveyor is mounted to the frame and is disposed beneath the screening device for catching particulate that passes through the screening device. The underscreen conveyor has an upper end near the upper end of the screening device and a lower end near the lower end of the screening device, and in a preferred embodiment the underscreen conveyor is substantially parallel to the screening device's screens.

A first lateral conveyor is mounted to the frame with an inboard end near one of the ends of the underscreen conveyor. The first lateral conveyor extends laterally outward from the frame for conveying particulate that falls onto the underscreen conveyor laterally of the frame. A second lateral conveyor is mounted to the frame with an inboard end near the lower end of the screening device. The second lateral conveyor extends laterally outwardly of the frame for conveying particulate that fails to pass through the lower screen of the screening device laterally of the frame.

A chute is connected to the frame at the lower end of the screening device and extends downhill from it for directing material that fails to pass through the upper screen off of the machine. A pair of endless tracks is mounted to the frame substantially intermediate the frame's length. The tracks are drivingly linked to a prime mover for driving the tracks, thereby moving the machine.

In a preferred embodiment the underscreen conveyor is only drivable in a downhill direction from the upper end to the lower end. Furthermore, the first lateral conveyor mounts near the lower end of the underscreen conveyor. This provides the advantage that the piles of material are both as close to the discharge end of the frame as possible, thereby permitting loading of the hopper from both sides without interference from the piles of particulate.

Figure 1:
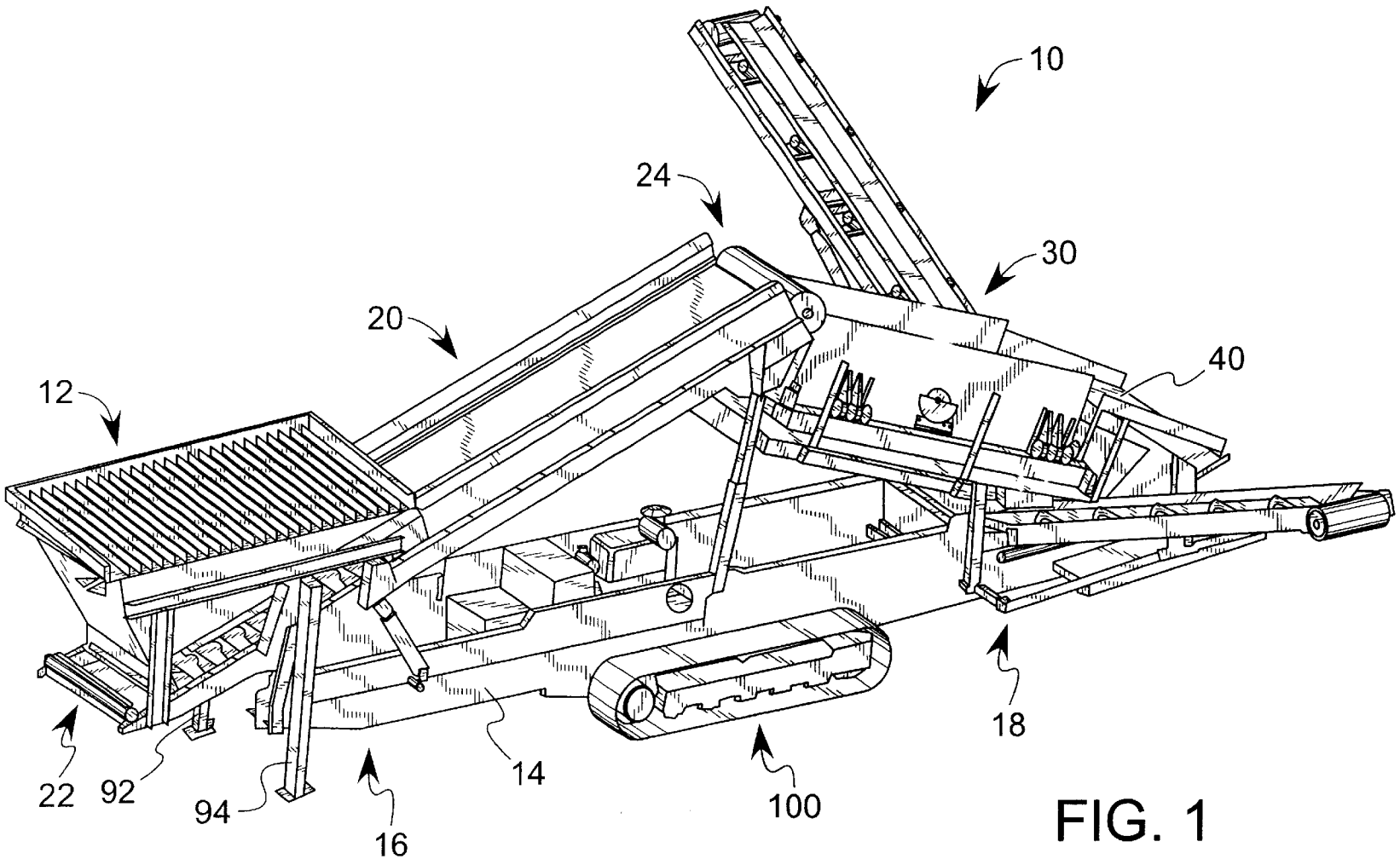
FIG. 1 is a view in perspective illustrating the preferred embodiment of the present invention in an operable position.

In describing the preferred embodiment of the invention which is illustrated in the drawings, specific terminology will be resorted to for the sake of clarity. However, it is not intended that the invention be limited to the specific term so selected and it is to be understood that each specific term includes all technical equivalents which operate in a similar manner to accomplish a similar purpose. For example, the word connected or term similar thereto are often used. They are not limited to direct connection, but include connection through other elements where such connection is recognized as being equivalent by those skilled in the art.

DETAILED DESCRIPTION OF THE INVENTION

Figure 2:
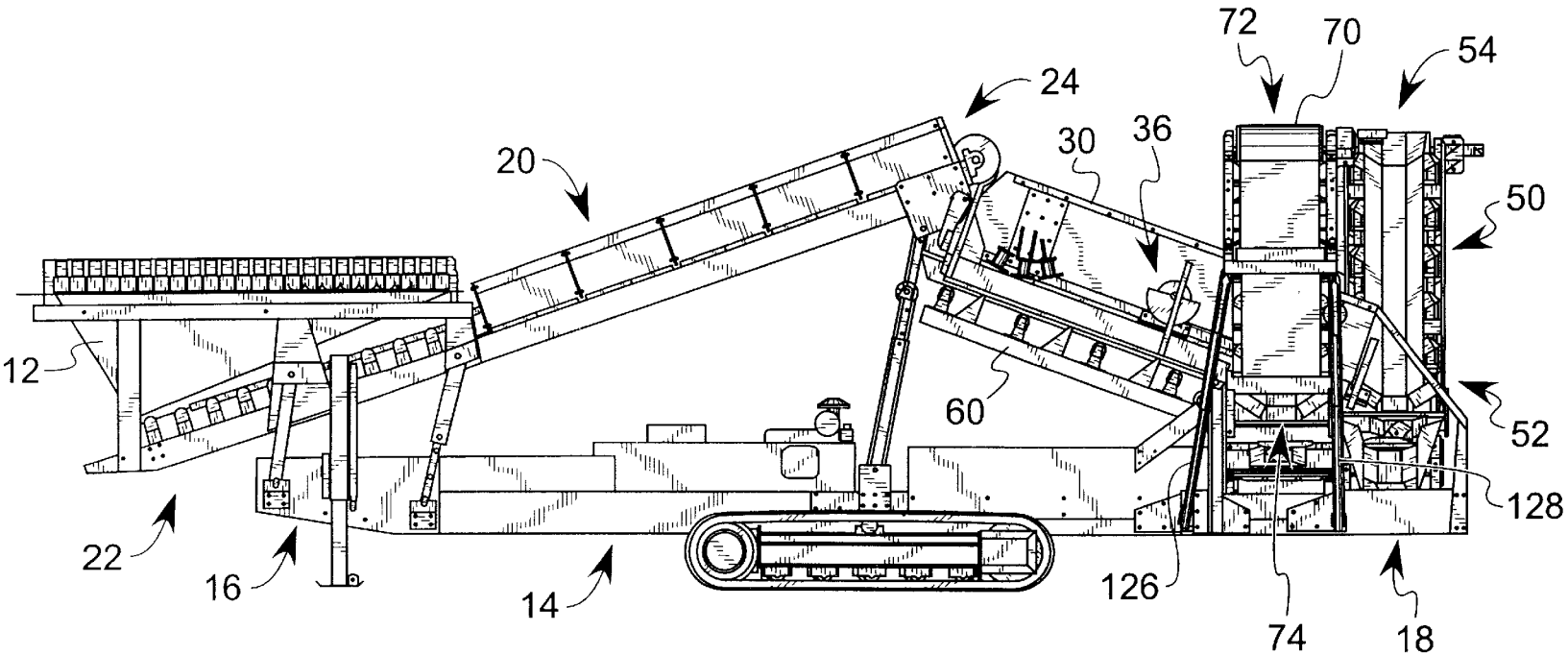
FIG. 2 is a side view illustrating the preferred embodiment of the present invention in an operable position.

The machine 10 is shown in FIGS. 1 and 2 in an operable position set up and ready to receive particulate material. The particulate is loaded into the machine 10 at the top side of the hopper 12. The hopper is mounted to the frame 14 of the machine 10, and the frame is an elongated, rigid, preferably steel structure to which essentially all of the components of the invention are mounted or connected to through other structures. The frame has a hopper end 16 and a discharge end 18, and particulate material moves, as it is processed, from the hopper end 16 toward the discharge end 18.

A main conveyor 20 is mounted to the frame 14 with its receiving end 22 beneath the lower end of the hopper 12. The main conveyor 20 extends longitudinally uphill toward the discharge end 18 of the frame 14 and terminates in a rejecting end 24 of the conveyor 20. The main conveyor 20 receives particulate poured into the hopper 12 and conveys it uphill toward its rejecting end 24.

The main conveyor 20 and other conveyors discussed below are conventional in their structure, inasmuch as they all have a pair of elongated, parallel arms held rigidly relative to one another, between which are rotatably mounted wheels, drums or other round-surfaced objects. A continuous loop belt extends between the parallel arms and substantially tightly around the wheels or drums. At least one of the wheels or drums is driven, such as by an electric or hydraulic motor, which drives the belt to revolve around the wheels lengthwise of the parallel arms.

Figure 3:
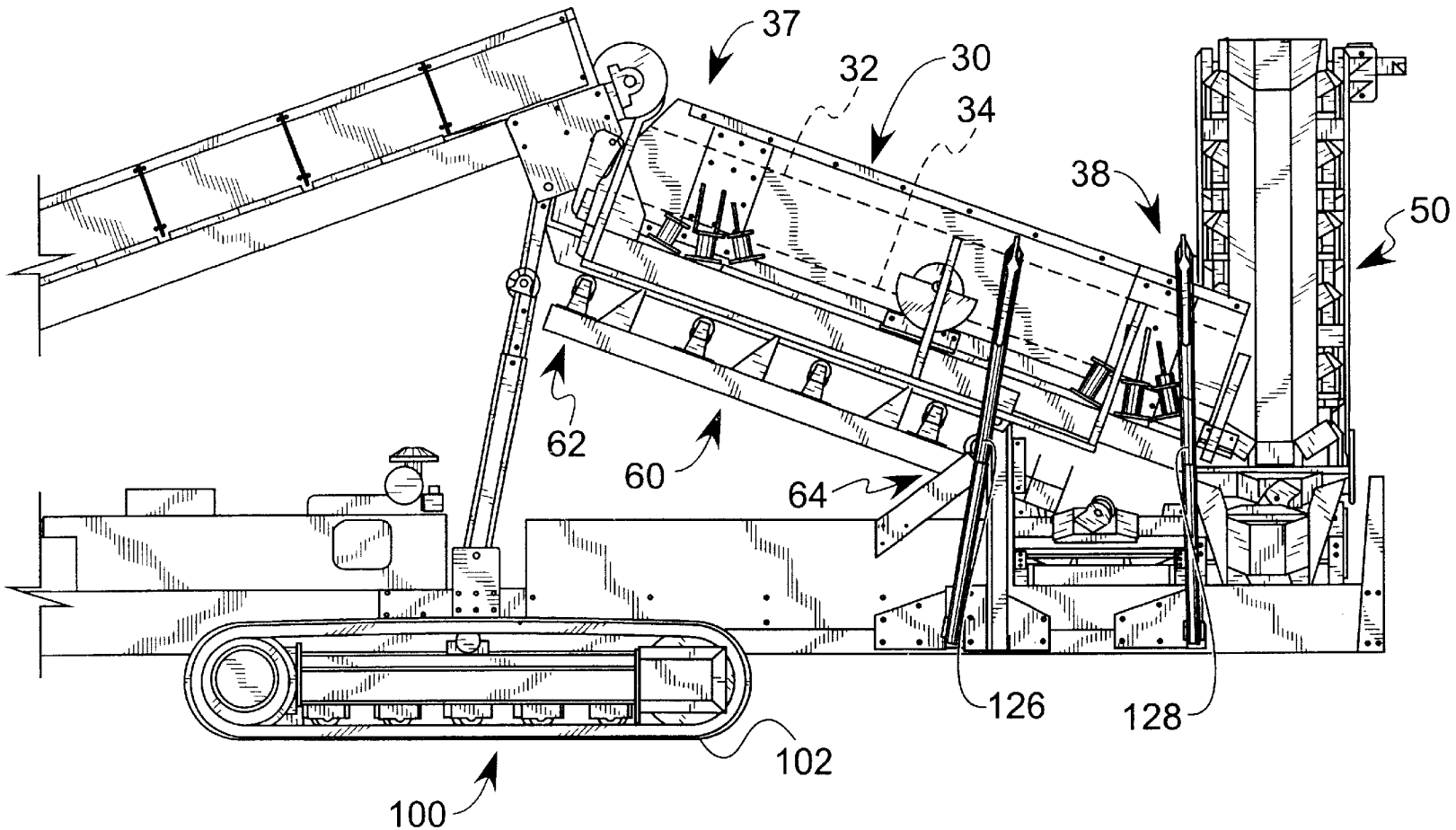
FIG. 3 is a side view illustrating the preferred embodiment of the present invention in an operable position.

With particular reference to FIGS. 2 and 3, a screening device 30, which preferably has a pair of screens 32 and 34, is mounted to the frame 14 beneath the rejecting end 24 of the main conveyor 20. A vibratory prime mover 36, such as a rotary hydraulic motor drivingly linked to eccentric weights, is drivingly linked to the screening device 30. Upon actuation of the motor, the eccentric weights are rotatably driven, causing the screening device 30 to vibrate rapidly. When particulate matter falls onto the screens 32 and 34, it is vibrated rapidly, thereby causing particulate to fall through the openings of the screens, and causing matter which fails to fall through the openings to be displaced in a downhill direction from the upper end 37 to the lower end 38 of the screening device 30.

Particulate matter that does not fall through the upper screen 32 is displaced downhill onto a chute 40 (see FIG. 1) that is mounted with its upper end near the lower end 38 of the screening device, and substantially in, or close below, the plane of the upper screen 32. Thus, the chute 40 guides the largest particulate off of the discharge end of the machine and away from the machine by gravity. The term "chute" includes an extension of the lower end of the upper screen 32 beyond the lower end of the lower screen 34, and other structures by which material is guided to the ground from the upper screen.

Figure 6:
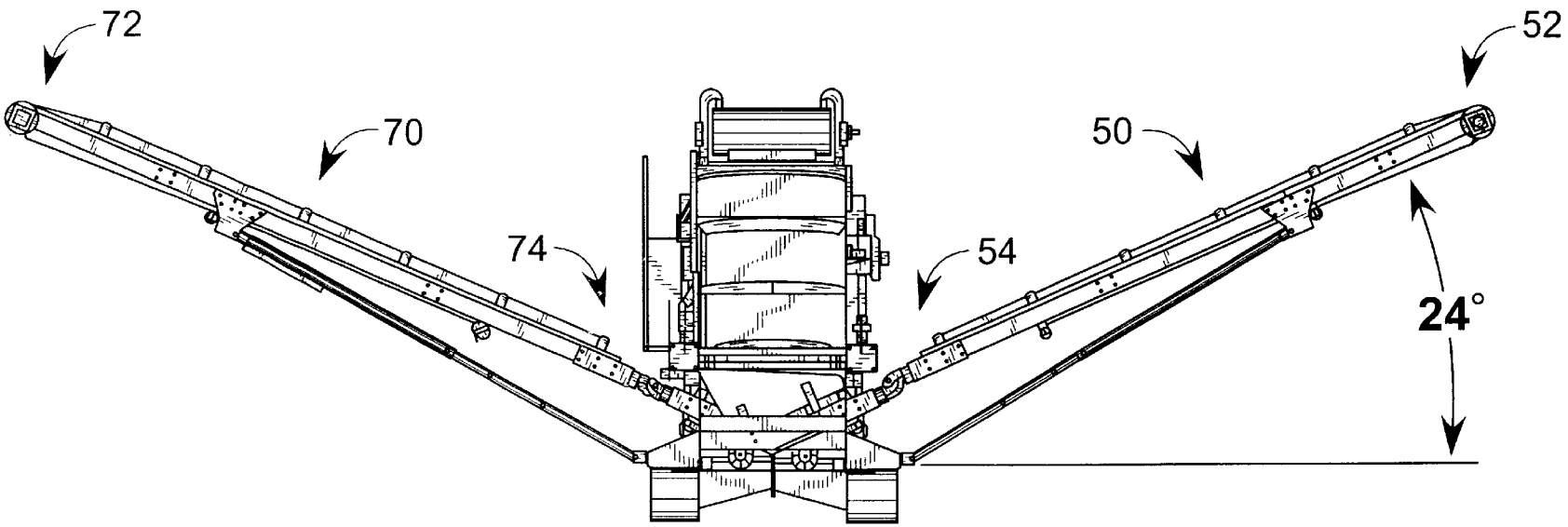
FIG. 6 is an end view illustrating the preferred machine.
Figure 7:
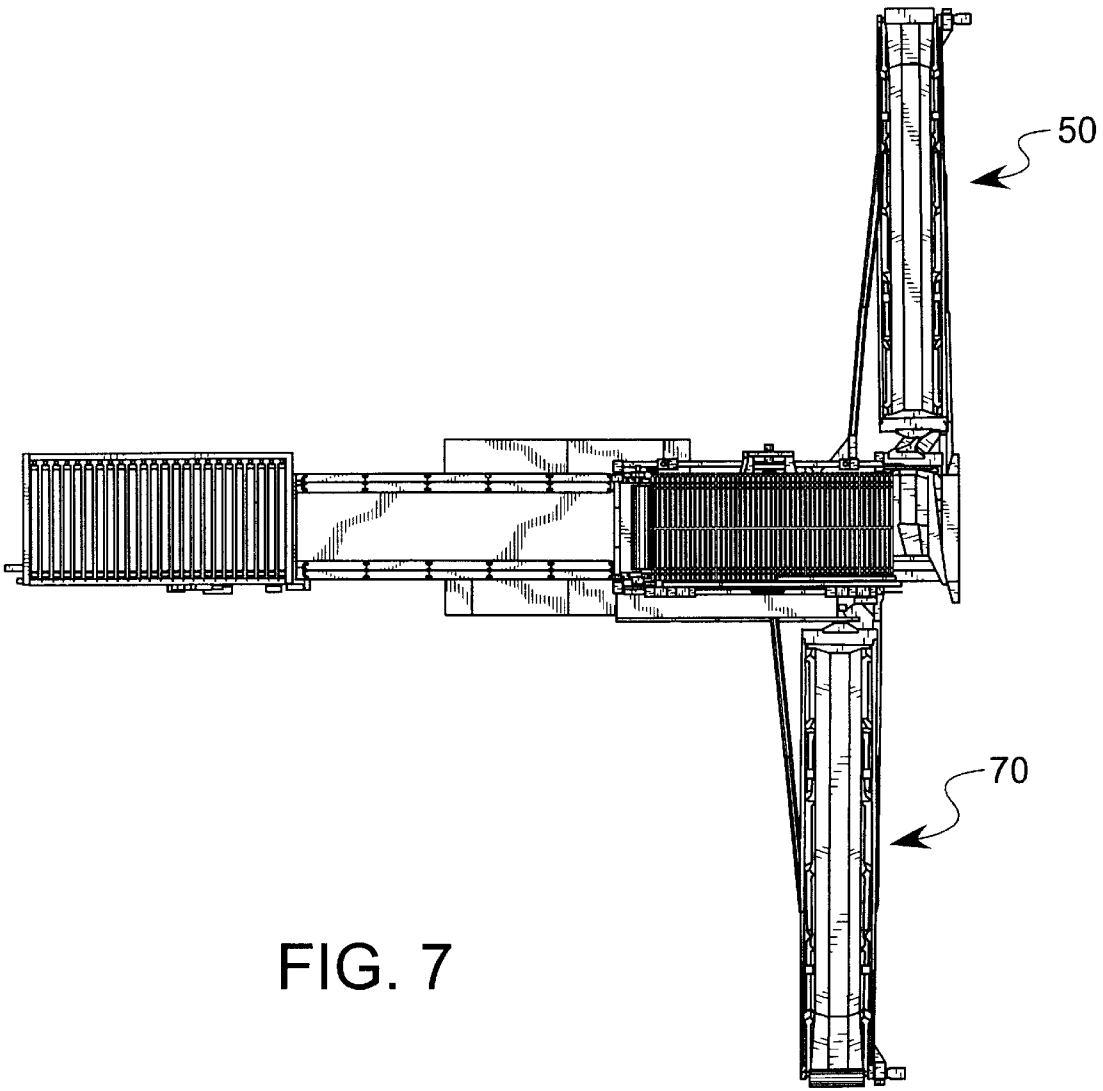
FIG. 7 is a top view illustrating the preferred machine.

At the lower end of the lower screen 34, the lower end of a lateral conveyor 50 is mounted to the frame 14. The lower end 52 of the lateral conveyor 50 is positioned just below the plane of the lower screen 34 in order to receive particulate that is displaced downwardly over the lower screen 34. That particulate that falls onto the lateral conveyor 50 is conveyed uphill toward the upper end 54 of the lateral conveyer 50, which is positioned laterally outwardly of the frame 14 from the lower end 52, and the particulate is dropped. The lateral conveyor 50 forms an angle with the ground of about 24 degrees (see FIG. 6).

An underscreen conveyor 60 is mounted to the frame 14 beneath the screening device 30 in a substantially parallel relationship. An upper end 62 and a lower end 64 of the underscreen conveyor 60 are positioned directly beneath the upper and lower ends of the lower screen 34, for receiving particulate matter that falls through the lower screen 34. This particulate matter will be the finest particulate that was in the mixture poured originally in the hopper 12, because the coarsest material fails to pass through the upper screen 32, and the next finer material passes through the upper screen 32, but not the lower screen 34. These separated materials are conveyed away from the machine 10 by the chute 40 and the lateral conveyor 50, respectively.

The material that falls onto the underscreen conveyor 60 is conveyed, in the preferred embodiment, downhill to the lower end 64 of the underscreen conveyor, which is above the lower end 72 of another lateral conveyor 70. The underscreen conveyor 60 drives its conveyor belt in a direction that conveys all particulate that falls onto the underscreen conveyor 60 downhill toward the lower end 64.

At the lower end of the underscreen conveyor 60, the lower end of the lateral conveyor 70 is mounted to the frame 14. The lower end 72 of the lateral conveyor 70 is positioned just below the lower end 64 of the underscreen conveyor 60 in order to receive particulate that is displaced downwardly by the underscreen conveyor 60. That particulate that falls onto the lateral conveyor 70 is conveyed uphill toward the upper end 72 of the lateral conveyer 70, and is positioned laterally outwardly of the frame 14 from the lower end 74, and the particulate is dropped. The lateral conveyor 70 forms an angle with the ground of about 24 degrees (see FIG. 6).

The machine shown and described functions as follows and with reference to FIGS. 1 through 5. Particulate matter is poured into the hopper 12 by one or more loaders. The hopper directs the material onto the main conveyor 20, which conveys the mixed particulate from the hopper 12 to the screening device 30. The vibrating screens of the screening device separate the mixed particulate into three sizes. The coarsest size falls off of the upper screen 32 onto the chute 40 and onto the ground in a pile 75 near the machine 10. The next coarsest matter falls through the upper screen 32, but not through the lower screen 34. This matter is driven downwardly onto the lateral conveyor 50, which conveys the matter outwardly of the machine 10 into a pile 80. The finest matter falls through the upper screen 32 and the lower screen 34 onto the underscreen conveyor 60. The underscreen conveyor 60 conveys the particulate matter downhill to the lateral conveyor 70, which conveys the matter outwardly of the machine 10 into a pile 90. In this manner, the machine 10 separates mixed particulate matter into three separate piles.

Figure 4:
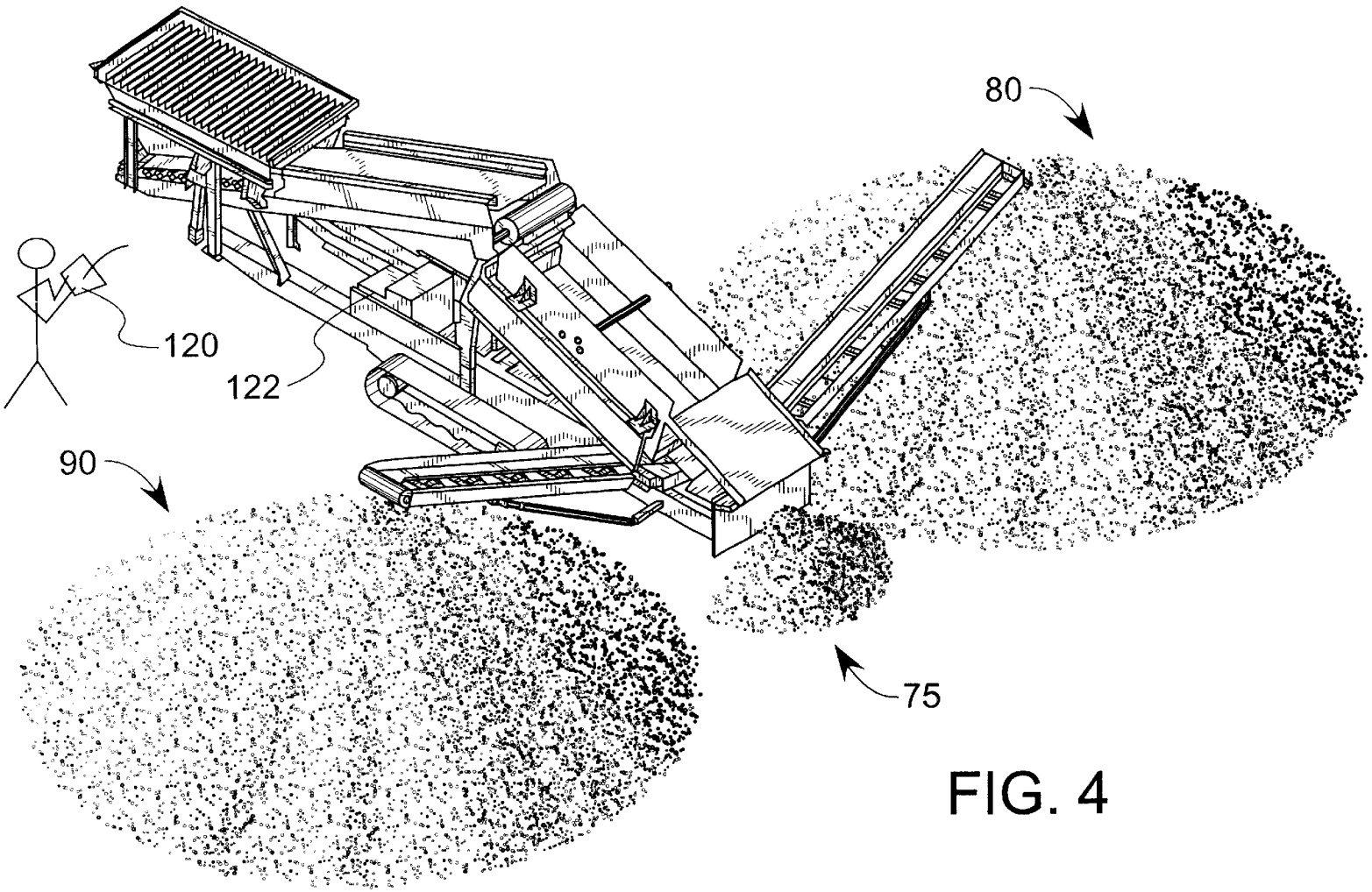
FIG. 4 is a view in perspective illustrating the preferred embodiment of the present invention in an operable position and showing the piles of particulate material.
Figure 5:
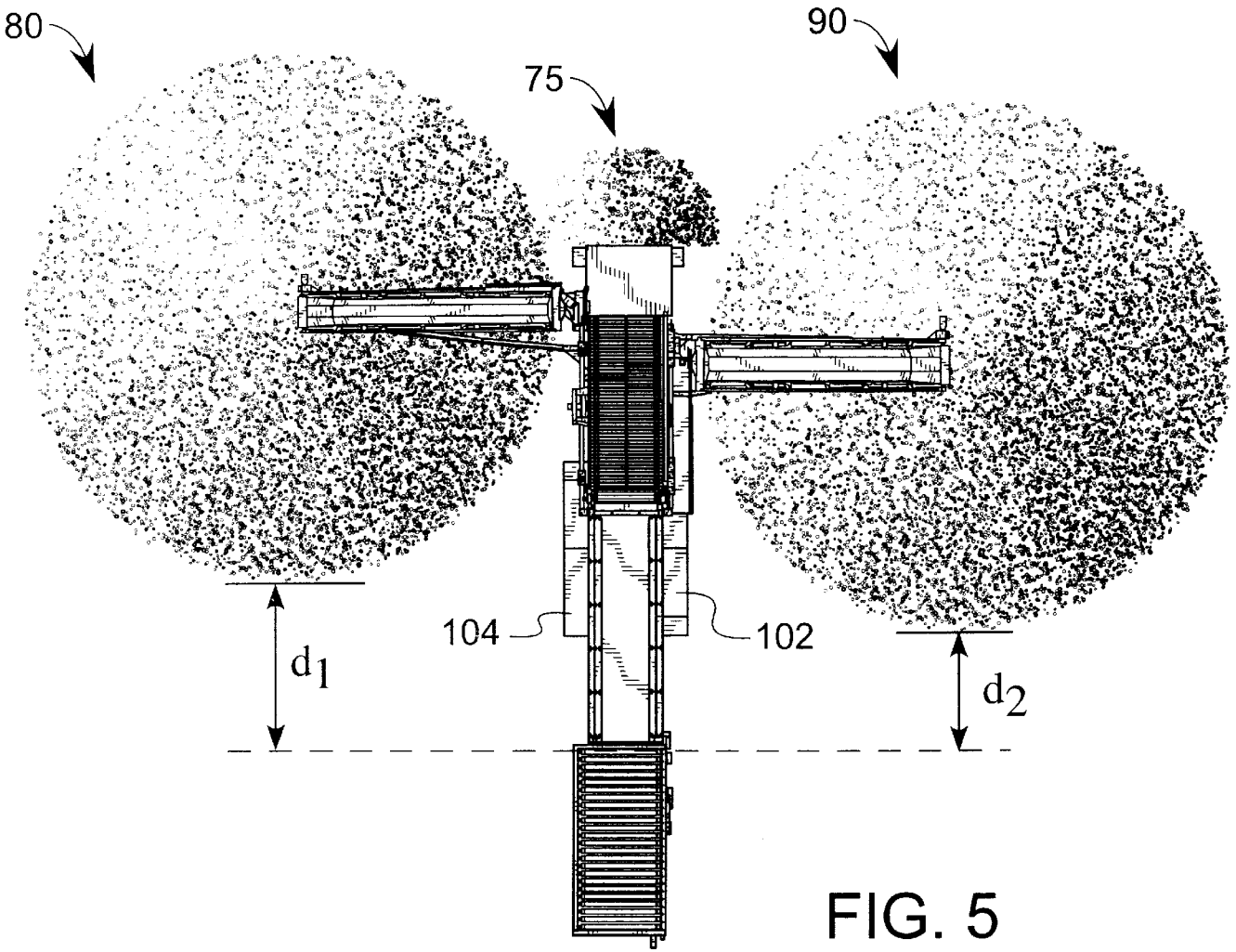
FIG. 5 is a top view illustrating the preferred embodiment of the present invention.

It will be appreciated from FIGS. 4 and 5 that the piles 80 and 90 are on opposite sides of the machine 10, and are both near the discharge end 19 of the frame 14. This permits loaders that pour particulate matter into the hopper 12 to approach and pour from both sides of the hopper 12, and from the rear side of the hopper 12. The ability to load the hopper 12 from any or multiple of these sides is a result of the lateral conveyors 50 and 70 being as close to the discharge end 18 of the frame as possible, which means the edges of the piles 80 and 90 are spaced distances $d_1$ and $d_2$ (see FIG. 5) from the closest end of the hopper 12. This is only possible when the underscreen conveyor is driven downhill, as in the preferred embodiment, because only when the underscreen conveyor is driven downhill can both lateral conveyors be at the same end of the screening device, and therefore as far from the hopper as possible. And the advantage of this structure is that two or more loaders can load the hopper 12, greatly speeding up the screening time.

Another advantage to the downhill underscreen conveyor 60 is that the particulate matter is always moving in the same direction; it never has to double-back as it does on some prior art machines. The advantage of this is that long objects do not get caught or thrown out at the turn-around point. They simply tumble down the screening device and off of the machine at the pile 75 where they should end up.

When it is time to move the machine 10, this is easily accomplished with the endless tracks apparatus 100. The endless tracks apparatus 100 includes a pair of endless tracks 102 and 104, similar to those found on bulldozers, military vehicles, etc. The operation of the tracks 102 and 104 is similar on the machine 10 as on the conventional machines, inasmuch as each of the tracks 102 and 104 extend around a driven sprocket or gear. The sprocket drives the tracks, and a plurality of idler wheels keep the tracks 102 and 104 in place and support the tracks 102 and 104 and therefore the machine 10. The driven sprockets are drivingly linked to a prime mover, preferably a hydraulic motor or a internal combustion engine mounted to the frame 14. The sprockets and idler wheels are rotatably mounted to the frame 14, or a member that is rigidly mounted to the frame 14. The endless tracks apparatus 100 is preferably mounted substantially intermediate the frame 14 to balance the machine 10. In order to balance the machine 10 under certain circumstances, such as when it is not moving, the legs 92 and 94 that are rigidly mounted to the frame 14 near the hopper end 16 can be lowered, for example by prime movers such as hydraulic rams, to seat against the ground for greater stability if necessary. The preferred legs pivot downwardly from a horizontal position to a vertical position by the action of the hydraulic rams that cause the pivoting.

Upon actuation, the sprockets are driven either both forward, both backward or one forward and one backward (in order to rotate the machine 10), as controlled by a remote control apparatus. The remote control apparatus includes a transmitter 120 either held by the operator or mounted in the vehicle loading the hopper 12, and a receiver 122 mounted on the machine 10 and connected to the controls for the machine 10. Thus, the operator actuates the machine 10 into operation by transmitting control signals to the receiver 122 from the transmitter 120, and the receiver 122 actuates the prime movers of the machine 10.

Another advantage to the present invention is that the machine can be moved short distances, such as less than the diameter of a pile of particulate, between times the particulate is dropped onto piles. This permits the formation of elongated piles of particulate, rather than just circular piles, thereby more efficiently storing the particulate matter.

Figure 8:
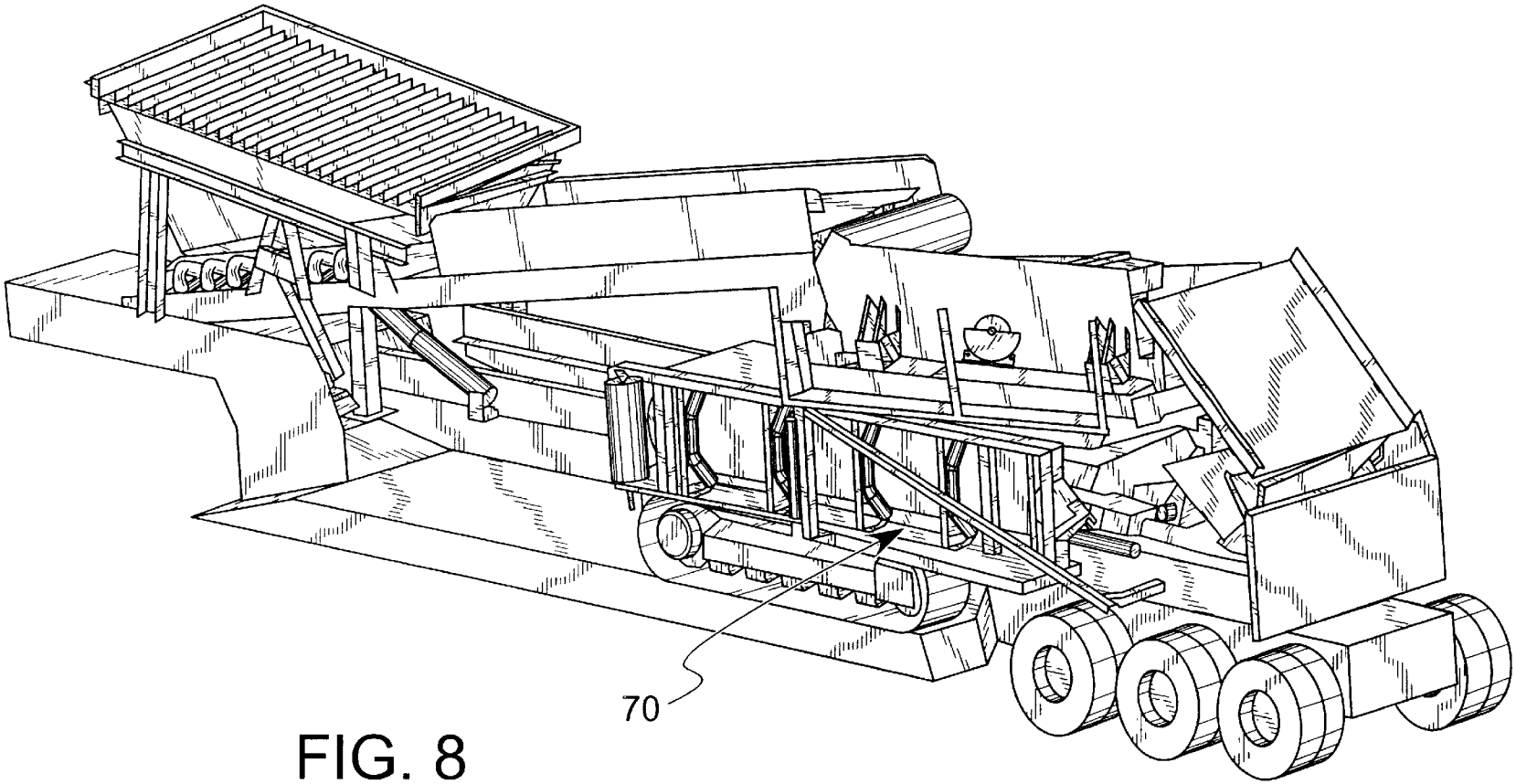
FIG. 8 is a view in perspective illustrating the preferred embodiment of the present invention in a position suitable for transport.

The lateral conveyors 50 and 70 can be folded inwardly for transportation (see FIG. 8) due to a hinge and support mechanism. The hinge and support mechanism for the conveyor 70, shown in FIGS. 1, 2 and 3 (FIG. 3 shows the conveyor 70 removed) includes a first pair 126 and a second pair 128 of nested tubes. The tubes 126 and 128 are mounted to the frame 14 at their lower ends and to the conveyor's 70 parallel arms at joints that pivot. A hydraulic ram within the tubes 126 is actuated when it is time to fold the conveyor 70 in, causing the conveyor to hinge along an arcuate path to the position shown in FIG. 8. The tubes 128 are free to move relative to one another longitudinally. This structure provides substantial support to the conveyors 50 and 70 during use, and allows them to fold up easily for transport.

Figure 9:
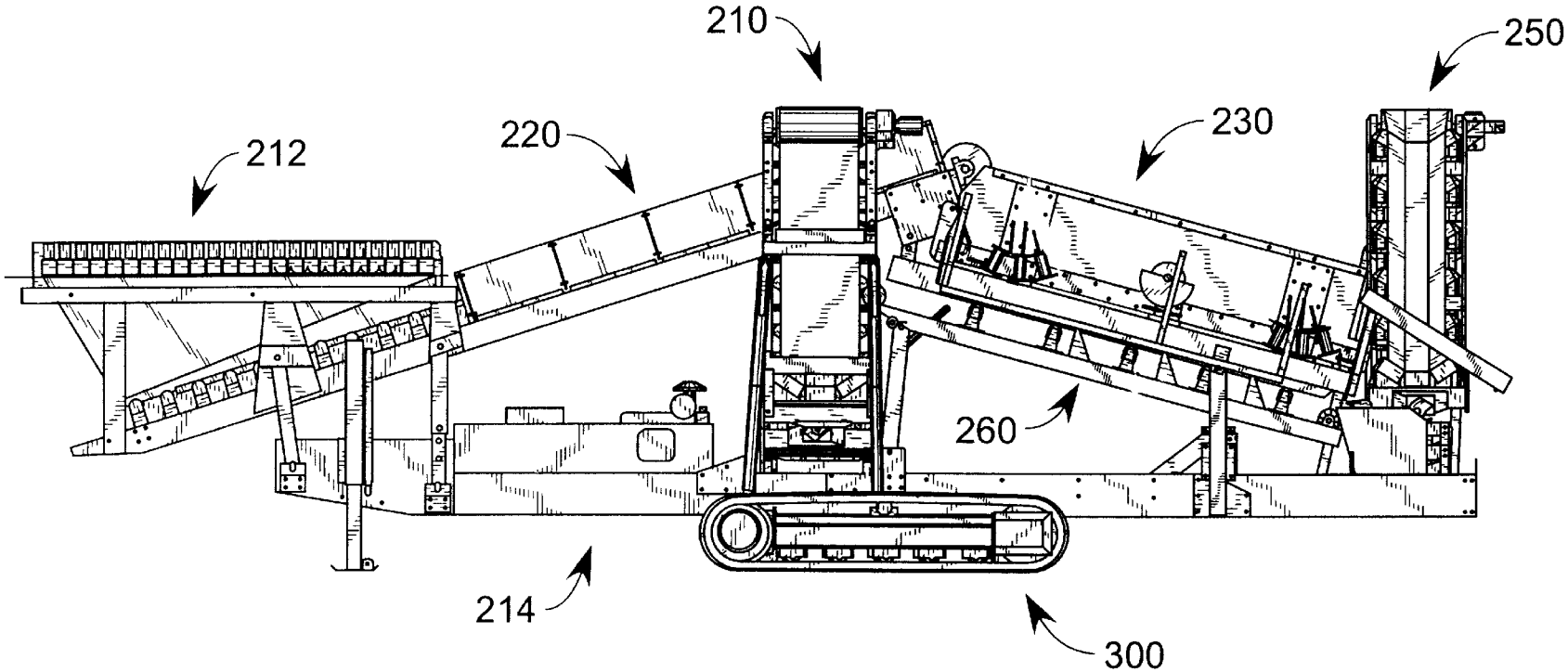
FIG. 9 is a side view illustrating an alternative embodiment of the present invention.
Figure 10:
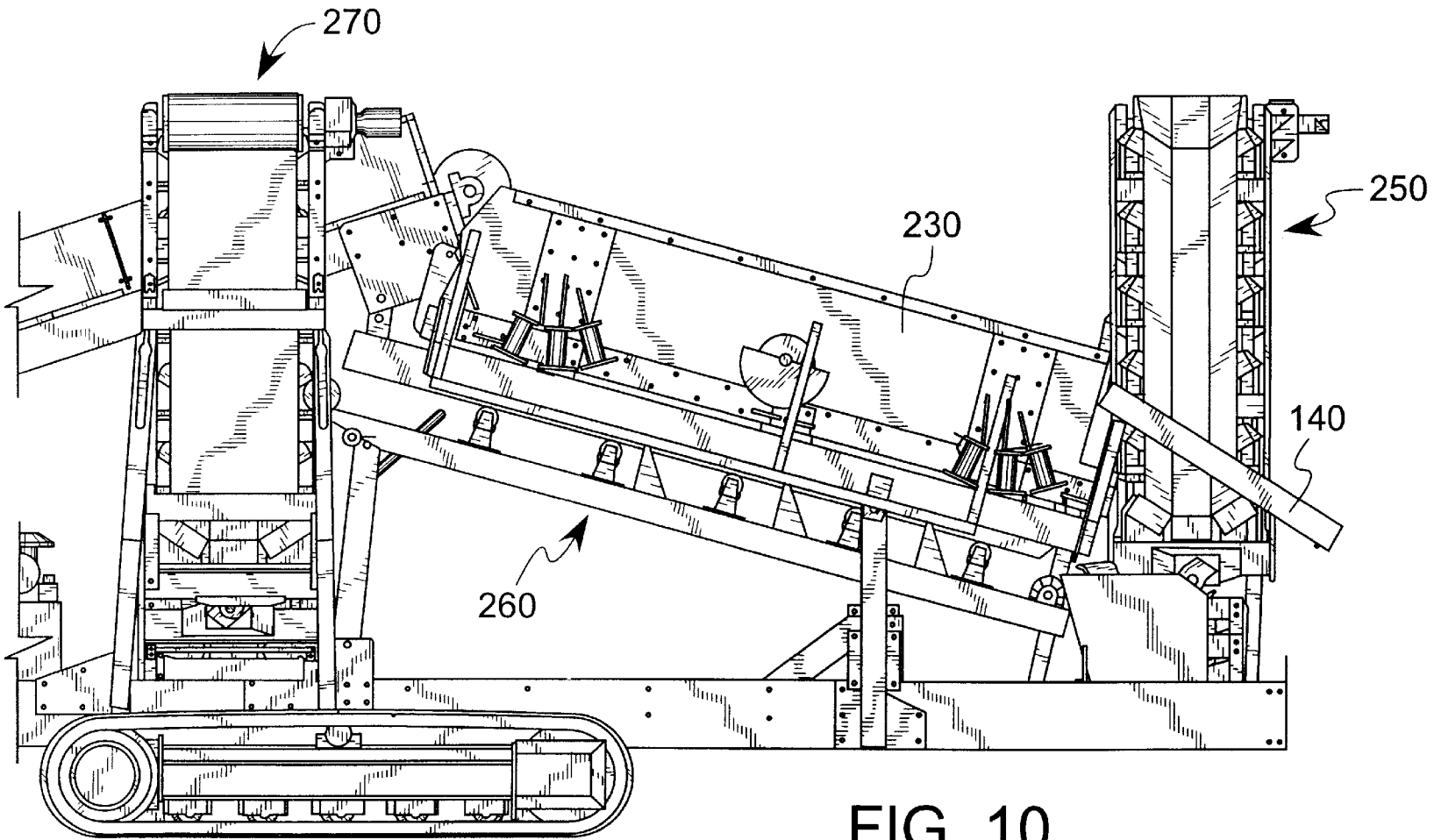
FIG. 10 is a side view illustrating an alternative embodiment of the present invention.
Figure 11:
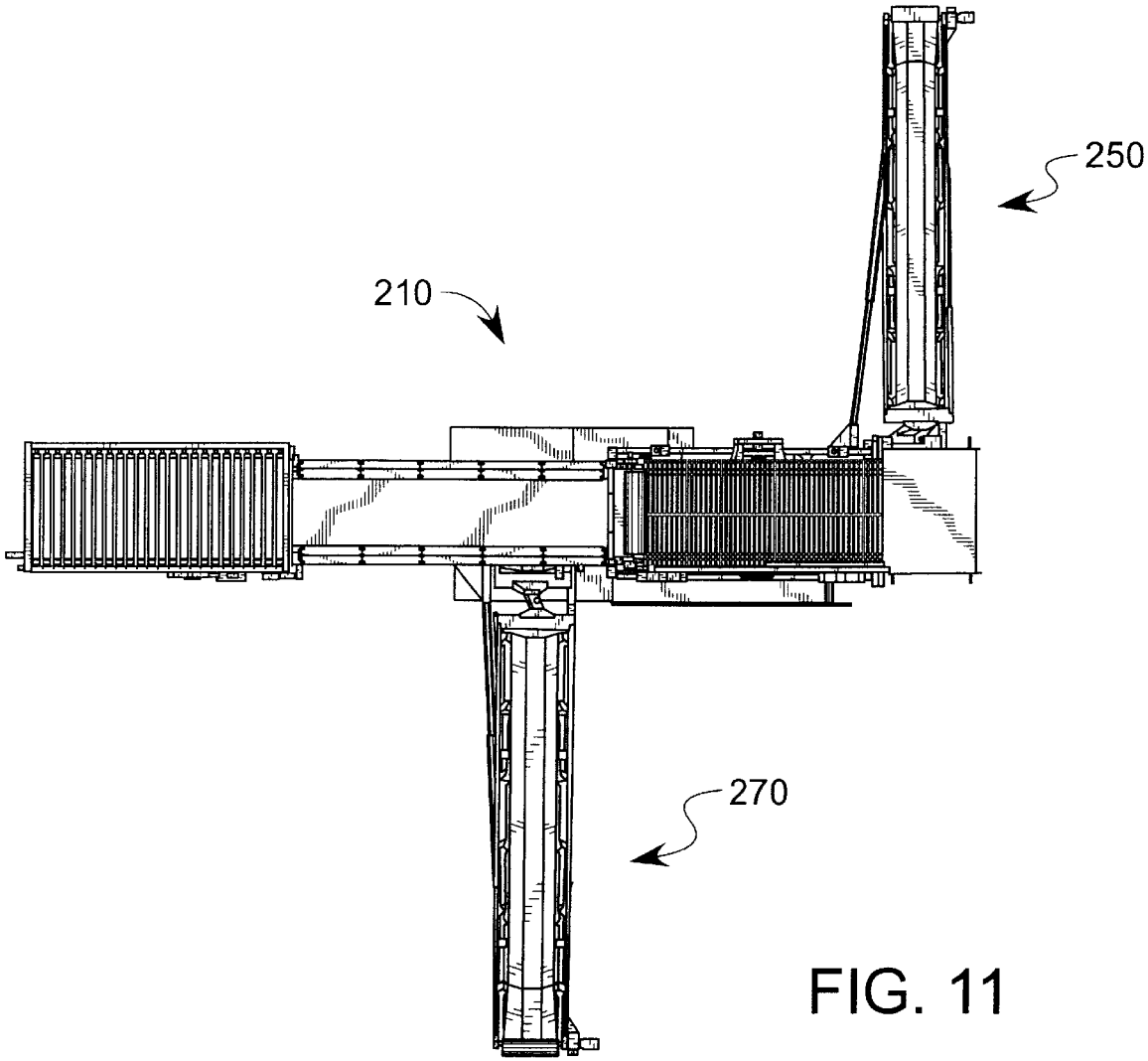
FIG. 11 is a top view illustrating an alternative embodiment of the present invention.
Figure 12:
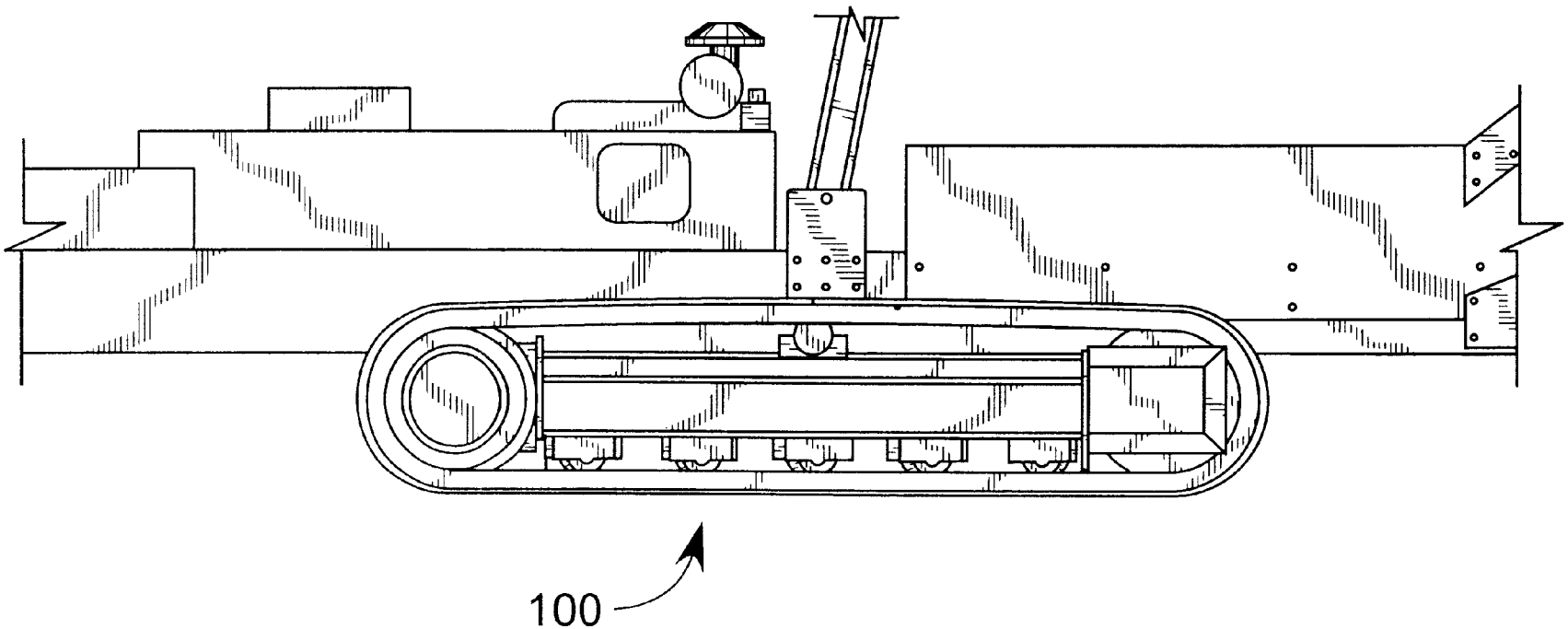
FIG. 12 is a side view illustrating the preferred tracks apparatus used on the present invention.

Although the underscreen conveyor that is driven only downhill is preferred, it is possible to have an uphill driven underscreen conveyor on the present invention. This is shown in FIGS. 9–11. These Figures show the machine 210 having a frame 214, a hopper 212, a main conveyor 220, a screening device 230, a tracks apparatus 300 and a lateral conveyor 250 essentially identical to the embodiment shown in FIG. 1. Two significant differences are the fact that the underscreen conveyor 260 is driven uphill and the lateral conveyor 270 is positioned at the uphill end of the underscreen conveyor 260 to receive the particulate that falls off of the upper end thereof. These differences result in a different machine 210, but one that has advantages over the prior art, nonetheless.

While certain preferred embodiments of the present invention have been disclosed in detail, it is to be understood that various modifications may be adopted without departing from the spirit of the invention or scope of the following claims.

What is claimed is:

1. A portable machine for screening particulate, the machine comprising:

(a) an elongated frame having a hopper end and an opposite, discharge end;

(b) a hopper mounted to the hopper end of the frame and configured to receive particulate matter poured into a top of the hopper;

(c) a main conveyor mounted to the frame and having a receiving end beneath the hopper, said main conveyor extending toward a main conveyor rejecting end;

(d) a vibratable screening device having a screen with screen openings, said screening device being drivably mounted to said frame beneath the rejecting end of the main conveyor, and said screening device extending from an upper end that is closer to the hopper end of the frame to a lower end that is closer to the discharge end of the frame;

(e) an underscreen conveyor mounted to the frame and disposed beneath the screening device for catching particulate that passes through the screening device, said underscreen conveyor having an upper end near the upper end of the screening device and a lower end near the lower end of the screening device, wherein the underscreen conveyor is only drivable in a downhill direction from the upper end to the lower end;

(f) a first lateral conveyor mounted to the frame with an inboard end near one of the ends of the underscreen conveyor and extending laterally outwardly of the frame, for conveying particulate that falls onto the underscreen conveyor laterally of the frame, wherein the first lateral conveyor mounts near the lower end of the underscreen conveyor; and (g) a pair of endless tracks mounted to the frame substantially intermediate the frame's length and drivingly linked to a prime mover for driving the tracks, thereby moving the machine.

2. The screening machine in accordance with claim 1, further comprising a second screen mounted on the screening device, and a second lateral conveyor mounted to the frame with an inboard end near the lower end of the screening device and extending laterally outwardly of the frame, for conveying particulate that fails to pass through the lower screen of the screening device laterally of the frame.

3. The screening machine in accordance with claim 2, further comprising a chute mounted at the lower end of time screening device and extending downhill therefrom for directing material that fails to pass through an upper screen off of the machine.

4. The screening machine in accordance with claim 2, wherein the first and second lateral conveyors are mounted to hinge means that permit the lateral conveyors to fold toward the frame.

5. The screening machine in accordance with claim 1, further comprising a pair of legs, each leg being movably mounted to the frame and drivingly linked to a prime mover.

6. The screening machine in accordance with claim 1, further comprising a receiver mounted on the machine and drivingly linked to actuators connected to the prime mover that is drivingly linked to the tracks, and a transmitter separate from the machine that is capable of transmitting a signal that the receiver can receive for driving the machine.

7. A method of screening comprising:

(a) positioning a portable screening machine on a work site, the machine comprising:

(i) an elongated frame having a hopper end and an opposite, discharge end;

(ii) a hopper mounted to the hopper end of the frame and configured to receive particulate matter that is poured into a top of the hopper from a first side located at a first lateral side of the frame, and a second, opposite hopper side located at a second, opposite lateral side of the frame;

(iii) a main conveyor mounted to the frame and having a receiving end beneath the hopper, said main conveyor extending toward a main conveyor rejecting end and conveying particulate from the hopper to the rejecting end of the main conveyor;

(iv) a vibrating screening device having an upper screen and lower screen with screen openings of different sizes, said screening device being mounted to said frame beneath the rejecting end of the main conveyor, and said screening device extending from an upper end that is closer to the hopper end of the frame to a lower end that is closer to the discharge end of the frame;

(v) an underscreen conveyor mounted to the frame and disposed beneath the screening device catching particulate matter that passes through the screening device, said underscreen conveyor having an upper end near the upper end of the screening device and lower end near the lower end of the screening device;

(vi) a first lateral conveyor mounted to the frame with an inboard end near one of the ends of the underscreen conveyor and extending laterally outwardly of the frame, the first lateral conveyor conveying particulate that falls onto the underscreen conveyor laterally of the frame;

(vii) a second lateral conveyor mounted to the frame with an inboard end near the lower end of the screening device and extending laterally outwardly of the frame, the second lateral conveyor conveying particulate that fails to pass through the lower screen of the screening device laterally of the frame;

(viii) a chute connected to the frame at the lower end of the screening device and extending downhill therefrom directing material that fails to pass through the upper screen off of the machine; and (ix) a pair of endless tracks mounted to the frame substantially intermediate the frame's length and drivingly linked to a prime mover for driving the tracks, thereby moving the machine;

(b) loading particulate matter into the hopper from the first side of the hopper;

(c) loading particulate matter into the hopper from the second side of the hopper; and (d) actuating the prime mover drivingly linked to the tracks and driving the machine.

8. The method in accordance with claim 7, further comprising the step of loading particulate matter into the hopper from a rear side of the hopper.

9. The method in accordance with claim 7, further comprising the step of driving the underscreen conveyor in a downhill direction to convey any particulate matter that falls thereon onto the first lateral conveyor.

10. The method in accordance with claim 7, further comprising the step of driving the machine onto a trailer.

11. The method in accordance with claim 7, further comprising the steps of driving the machine a pile diameter, stopping the machine and then repeating the steps of loading particulate matter into the hopper for creating an elongated pile.

* * * * *